United States Patent [19]

Fujiwara

[11] Patent Number: 4,799,080

[45] Date of Patent: Jan. 17, 1989

[54] ELECTROPHOTOGRAPHIC COPYING MACHINE HAVING EDITORIAL FUNCTION

[75] Inventor: Masakatsu Fujiwara, Hyogo, Japan

[73] Assignee: Sanyo Electric Co., Ltd., Japan

[21] Appl. No.: 918,500

[22] Filed: Oct. 14, 1986

[30] Foreign Application Priority Data

| | | | |
|---|---|---|---|
| Oct. 19, 1985 | [JP] | Japan | 60-234332 |
| Nov. 13, 1985 | [JP] | Japan | 60-254141 |
| Nov. 18, 1985 | [JP] | Japan | 60-258044 |

[51] Int. Cl.[4] ..... G03G 15/00

[52] U.S. Cl. ..... 355/7; 355/25

[58] Field of Search ..... 355/7, 25, 39, 40, 3 R

[56] References Cited

U.S. PATENT DOCUMENTS

| | | | |
|---|---|---|---|
| 4,303,332 | 12/1981 | Sakai | 355/7 X |
| 4,371,898 | 2/1983 | Nakamura | 355/7 X |
| 4,582,417 | 4/1986 | Yagasaki et al. | 355/7 |
| 4,585,334 | 4/1986 | Malyon | 355/3 R X |
| 4,685,794 | 8/1987 | Watanabe | 355/7 |
| 4,687,317 | 8/1987 | Appel et al. | 355/3 R |

FOREIGN PATENT DOCUMENTS

| | | | |
|---|---|---|---|
| 204066 | 12/1982 | Japan | 355/7 |
| 59-77768 | 5/1984 | Japan | 355/7 |

*Primary Examiner*—Patrick R. Salce
*Assistant Examiner*—Marc S. Hoff
*Attorney, Agent, or Firm*—Darby & Darby

[57] ABSTRACT

An electrophotographic copying machine having an editorial function includes an original table formed on the top surface of a main unit, and an original is placed thereon while facing upward. A shaft is installed in the vicinity of one end of the top surface of the main unit, and this shaft supports rotatably an optical system for scanning the original so as to be able to contact with or part from the original table. A transparent tablet is placed between the original and the optical system, and this table works in cooperation with a write pen. After placing the original, an operator puts the tablet thereon and operates the pen to specify the position of the original intended to be edited. Responsively, the positional data thereof is outputted from the tablet. In a trimming mode or a masking mode, LEDs constituting a partial eraser are lighted in response to the positional data, and an electrostatic latent image on a photosensitive drum is modified. In a centering mode, paper feed timing is controlled in response to the positional data.

28 Claims, 15 Drawing Sheets

ELECTROPHOTOGRAPHIC COPYING MACHINE HAVING EDITORIAL FUNCTION

BACKGROUND OF THE INVENTION

1. Field of the Invention

The present invention relates to an electrophotographic copying machine having an editorial function. More specifically, the present invention relates to an electrophotographic copying machine which forms an electrostatic latent image directly on a photosensitive member by the reflected light in scanning an original and performs image editing such as trimming, masking or centering in accordance with the electrostatic latent image.

2. Description of the Prior Art

Two kinds of copying machines capable of editing an image, in rough classification, have been already put on sale. A first one is, for example, a combination of the "FP-1520" and the processing table "FA-T100B4" manufactured by Matsushita Electric Industrial Co., Ltd., being disclosed, for example, in the Japanese Patent Laid-Open No. 87470/1984 laid open on May 21, 1984. A second one is, for example, the "NP-9030" manufactured by Canon, Inc. or the "U-Bix1810MR" manufactured by Konishiroku Photo Industry Co., Ltd.

The first prior art is such that an original is placed on an editor for editing an image; and positions of trimming, masking and the like are specified by an input pen, and thereafter the original is transferred to an original table to execute copying processing.

The second prior art is such that an original is placed facing upward, a transparent sheet with coordinates is further placed thereon. Coordinates of the position of the original are found through the transparent sheet, and they are entered through keys. Thereafter the original is turned over and put on the original table to execute copying processing.

In the first prior art, the original has to be put on the original table in the copying stage after specifying the position for editing the image, and therefore the specified position sometimes deviates from the position of the original. Also, this first prior art cannot accommodate a thick original such as a book.

In the second prior art, since the editorial position is specified through keys, operation is complicated, the original has to be turned over, and the position deviates as in the first prior art.

SUMMARY OF THE INVENTION

Therefore, a principal object of the present invention is to provide an electrophotographic copying machine having an editorial function which eliminates deviation of the specified editorial position.

Another object of the present invention is to provide an electrophotographic copying machine having an editorial function which facilitates editorial operation.

To be brief, the present invention is an electrophotographic copying machine having an editorial function which comprises an original table for placing an original with an original face to be copied facing upward and a tablet which is composed of a transparent or semi-transparent material, disposed on the original face of the original placed on the original table and can specify a position by a pen, a movable light source, optical scanning means for scanning the original face on the original table, a photosensitive member which is exposed by the light from the optical scanning means, and image forming means for forming a copied image in accordance with the positional data from the tablet by means of the photosensitive member and that positional data.

In the present invention, an original is put on the original table with the original face to be copied facing upward. The tablet is placed on the original face of the original. The tablet is transparent or semi-transparent, and accordingly the position on the original face can be ascertained visually through the tablet. The position on the original face intended to be edited is specified on the tablet by a pen. The tablet generates positional data according to the position of the pen, that is, the position of the original face. On the other hand, the optical scanning means performs exposure-scanning on the original face from above. At this time, the tablet is left intact or removed from the original face. The photosensitive member is exposed by the light from the optical scanning means, and an electrostatic latent image is formed on the photosensitive member. The image forming means forms a copied image edited in accordance with the positional data from the above-described tablet by means of the electrostatic latent image formed on the photosensitive member and that positional data.

In accordance with the present invention, the original is placed with the original face facing upward, the position is specified by the tablet and the pen from above the original face, and copying can be performed with the original left intact. Unlike either of the above-described first and second prior arts, the specified position never deviates from the position on the original face.

Also, in accordance with the present invention, the position can be specified by the tablet and the pen, and therefore operation for specifying the position is very simple in comparison with the case of key entry as in the case with the second prior art.

Furthermore, by making the original table capable of accommodating a thick original as in the case with the embodiment, copying and editing of a book or the like can be further facilitated.

These objects and other objects, features, aspects and advantages of the present invention will become more apparent from the following detailed description of the embodiments of the present invention when taken in conjunction with accompanying drawings.

DESCRIPTION OF THE PREFERRED EMBODIMENTS

Figure 1:
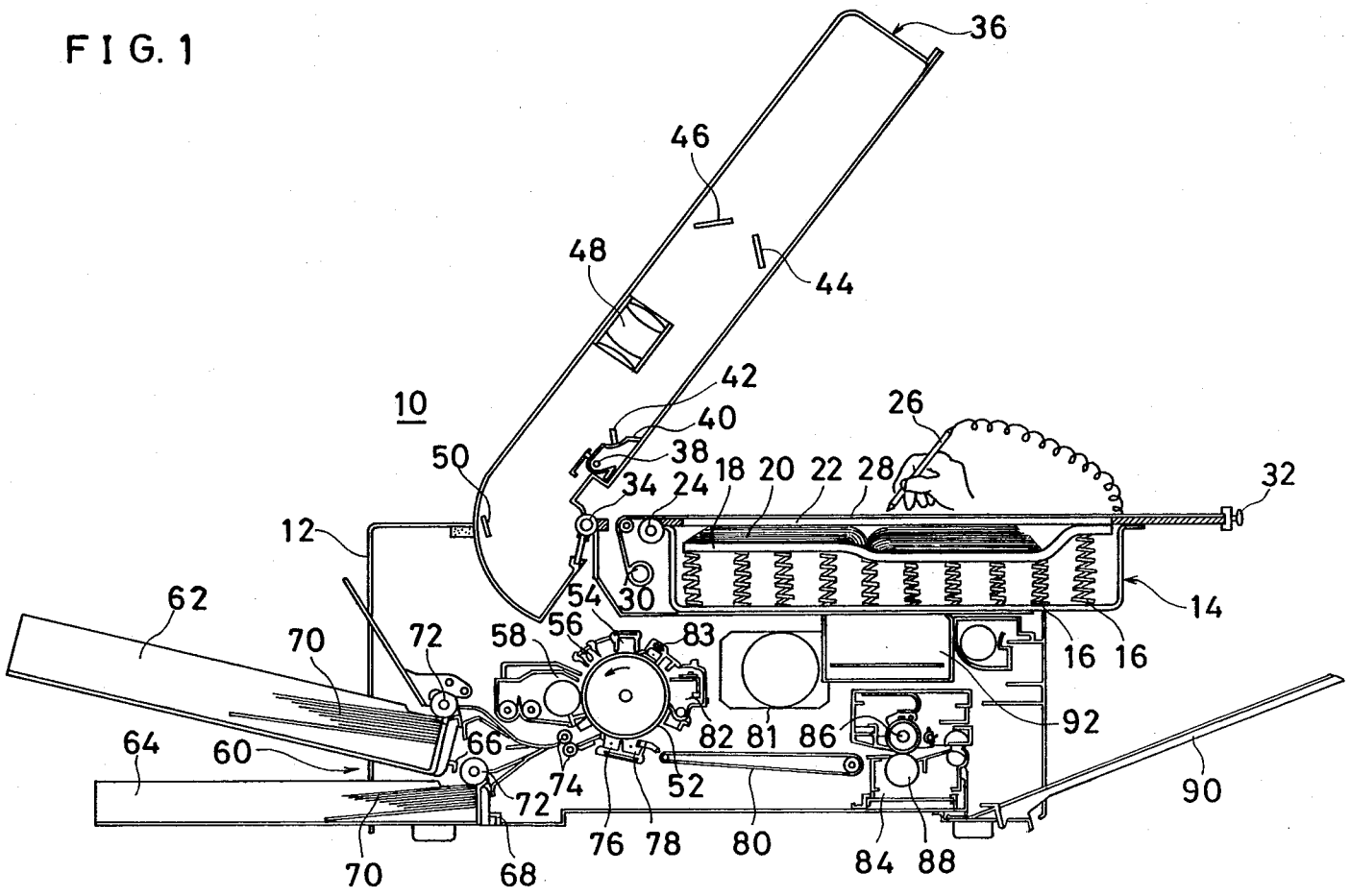
FIG. 1 is an illustrative structural view showing one embodiment in accordance with the present invention.

FIG. 1 is an illustrative cross-sectional view for explaining one embodiment in accordance with the present invention. An electrophotographic copying machine 10 includes a main unit 12, and an original table 14, which has an opening at the top and is box-shaped as a whole, is installed in a fixed fashion on the top surface of this main unit 12. Inside the original table 14, a plurality of coil springs 16, 16,—are installed so that the elastic forces thereof act upward. The bottom ends of the respective coil springs 16 are fixed to the bottom plate of the original table 14, and a flexible original holding plate 18 is mounted on the top ends of the coil springs 16. Thus, by supporting the flexible original holding plate 18 by a plurality of coil springs 16, the machine 10 can accommodate not only a sheet original but also a thick original such as a book. When an original 20 put on the original holding plate 18 is pushed from above, the original holding plate 18 is deformed responding to the thickness of the original 20, and therefore, as shown in FIG. 1, the face to be copied, that is, the original face of the original can be held flat at a predetermined height.

Meanwhile, in order to accommodate a thick original such as a book, an elevator member capable of moving up and down may be used, besides using the above-described coil springs 16 and the flexible original holding plate 18.

Figure 2:
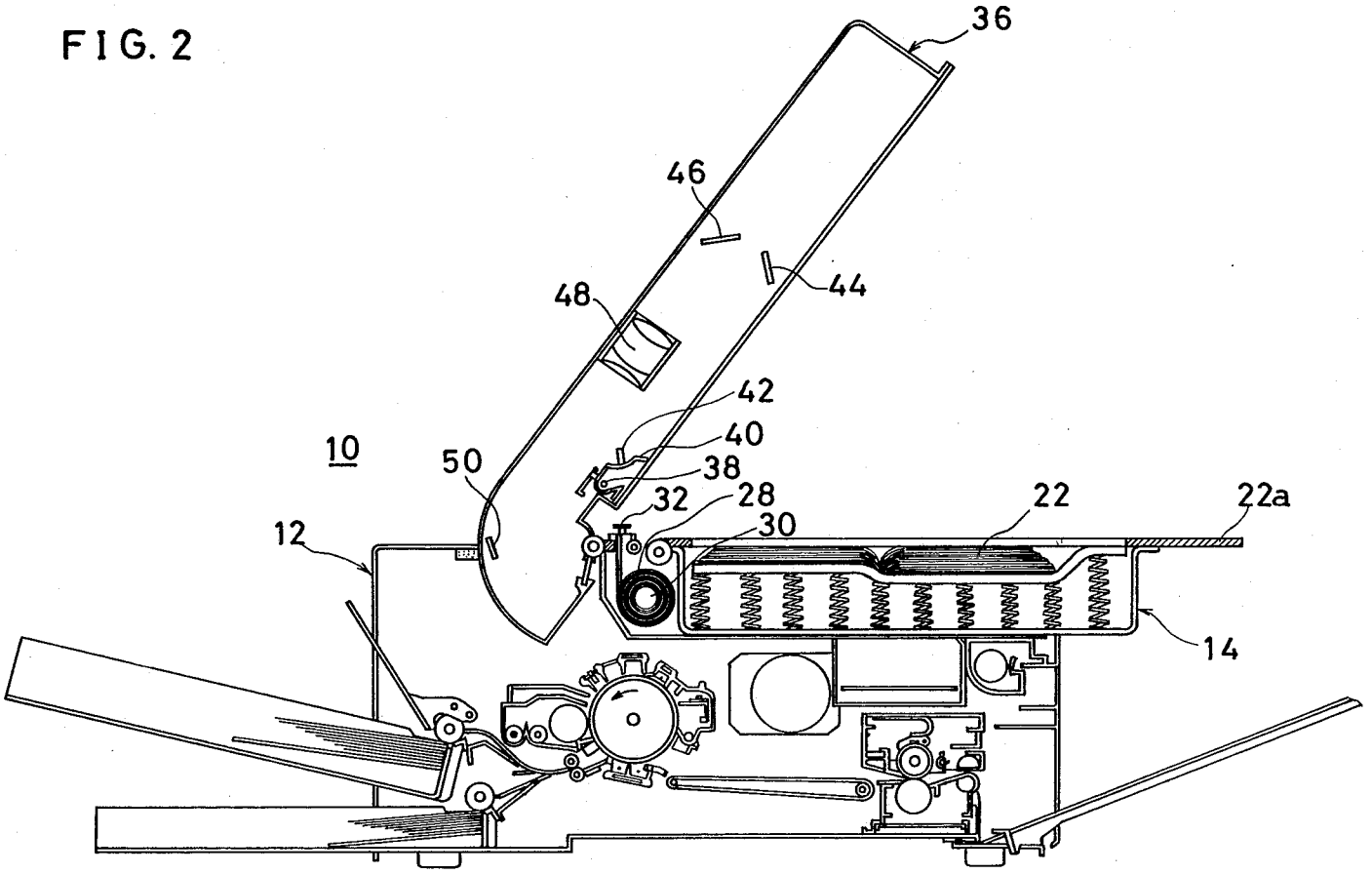
FIG. 2 and FIG. 3 are illustrative structural views showing operation of the FIG. 1 embodiment.

An original cover 22 formed with a transparent material such as glass is supported in a manner capable of opening and closing by a shaft 24 at one end of the top part of the original table 14. A tablet 28 capable of specifying the position by a write pen 26 is installed on the original cover 22. This tablet 28 is composed of a flexible transparent or semi-transparent sheet member, and includes transparent electrodes disposed in a matrix pattern as described in detail later in reference to FIG. 5. One end of the tablet 28 is attached to a take-up roller 30, and a knob part 32 is formed at the other end thereof. Then, the tablet 28 is normally spooled up by the take-up roller 30 to be accommodated as shown in FIG. 2, and the same is drawn out by the knob part 32 and is hooked at an end part 22*a* of the original cover 22 only when specifying the position for editing by operating the write pen 26. Thus, the tablet 28 constituting position specifying means can be disposed on the original face of the original 20 only when required.

Figure 3:
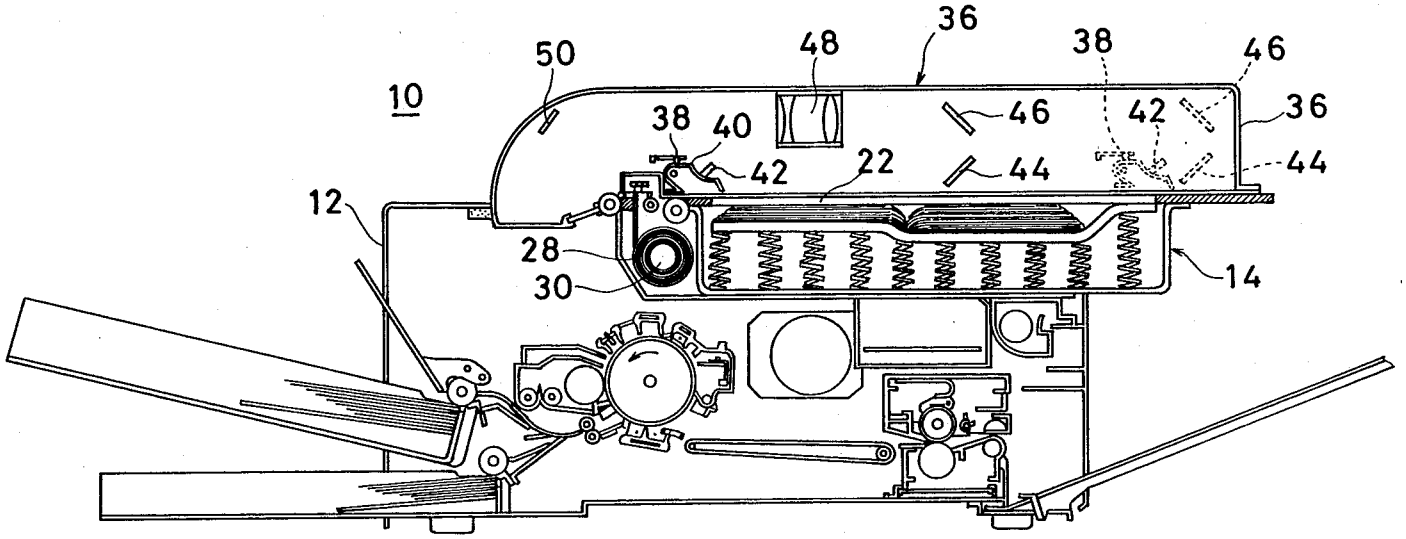

A shaft 34 is installed in the upper vicinity of the take-up roller 30, and an optical system 36 is supported by this shaft 34 so as to be capable of opening upward and closing downward. In the optical system 36, a movable light source, constituting a part of scanning means, is installed so as to be movable from one end to the other end and vice versa as shown in FIG. 3, in order to scan the original face of the original 20 while exposing. A reflecting mirror 40 having an elliptic cross-section is installed in association with the movable light source 38. A first movable mirror 42 is fixed to the reflecting mirror 40. When the movable light source 38 is moved by a servo motor (not shown) to the position shown by dotted lines in FIG. 3, the original 20 whose original face is flattened by the original cover 22 is slit-exposured. Second movable mirrors 44 and 46 are installed in association with the first movable mirror 42, and these second movable mirrors 44 and 46 are for reflecting further the original image reflected by the first movable mirror 42 towards a zoom lens 48. Since the zoom lens 48 is employed, this electrophotographic copying machine 10 is constituted in a variable magnification fashion. Then, a pair of the second movable mirrors 44 and 46 are moved in the same direction as that of this movable light source 38 at a speed which is half the moving speed of the movable light source 38. In front of the zoom lens 48, a fixed reflecting mirror 50 for reflecting the original image transmitted through the lens 48 toward a photosensitive drum 52 is installed.

A charging corotron 54 for uniformly charging the photosensitive drum 52 in a specific polarity is installed upstream from the position of exposure of the photosensitive drum 52, that is, the position where the original image is produced by the reflecting mirror 50.

Figure 8:
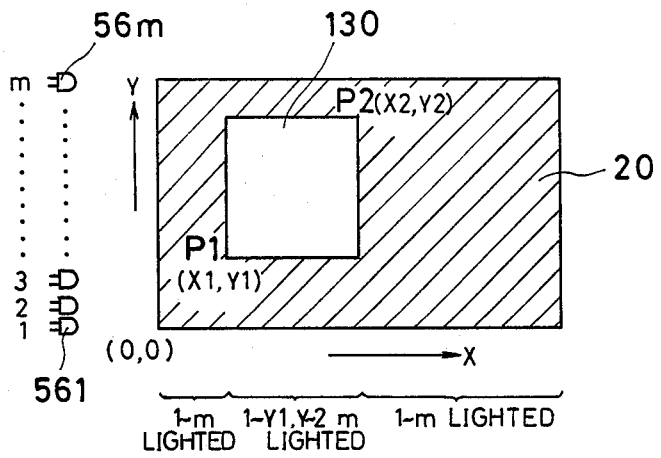
FIG. 8 is an illustrative view showing a trimming mode.
Figure 9:
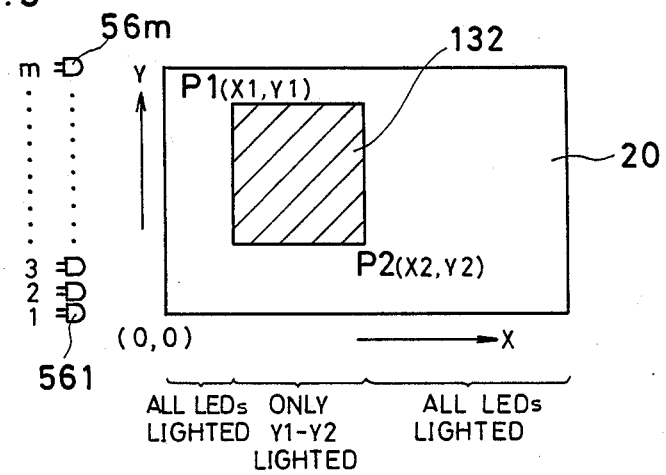
FIG. 9 is an illustrative view showing a masking mode.

A partial erase lamp 56 wherein a plurality of LEDs are arranged in a line in the direction of width of the photosensitive drum 52 is installed in parallel with the shaft of the photosensitive drum 52 downstream from the above-described position of exposure of the photosensitive drum 52. The partial erase lamp 56 is constituted as an LED array including a plurality of LEDs 56*l*–56*m* as shown in FIG. 8 or FIG. 9. Such a partial erase lamp 56, as described later, is utilized for partially erasing the electrostatic latent image formed on the photosensitive drum 52 when editing the image in response to positional information for editing.

A developing apparatus 58 is installed further downstream from the partial erase lamp 56. The developing apparatus 58 develops the electrostatic latent image formed on the photosensitive drum 52, using toner.

A paper feeding part 60 is formed at one end of the copying machine main unit 12, and in this embodiment, two paper feed cassettes 62 and 64 are loaded in this paper feeding part 60 in a manner to permit loading and unloading. Paper size sensors 66 and 68 are installed respectively at the tip parts of the paper feed cassettes 62 and 64. Among papers 70 accommodated in the paper feed cassette 62 and 64, the uppermost paper is pushed against a paper feed roller 72. The paper-feed roller 72 removes the pushed paper 70 one by one in sequence in the direction of register roller 74 by means of rotation thereof.

A transferring corotron 76 and a separating corotron 78 are installed in a one-piece fashion downstream from the developing apparatus 58. When the paper 70 is fed from the paper feed cassette 62 or 64, a toner image formed on the photosensitive drum 52 is transferred to the paper 70 by the transferring corotron 76. In transferring by the transferring corotron 76, the paper is attracted to the photosensitive drum 52 and is about to move together with this photosensitive drum 52, but is separated by the separating corotron 78, being sent toward a vacuum conveyor 80.

A cleaning apparatus 82 is installed along the photosensitive drum 52 downstream from the transferring corotron 76 (upper right thereof in FIG. 1), and this cleaning apparatus 82 removes the toner left on the photosensitive drum 52 after transferring.

A full erase lamp 83 is installed further upstream from the cleaning apparatus 82, that is, between the charging corotron 54 and the cleaning apparatus 82.

The paper separated from the photosensitive drum 52 by the separating corotron 78 is sent to a fixing apparatus 84 by the vacuum conveyor 80. The fixing apparatus 84 includes a heating roller 86 incorporating a heater and a pressing roller 88 for press-contacting the paper with this heating roller 86. Accordingly, the toner image transferred on the paper 70 is heated and pressed by the two rollers 86 and 88, being fixed to the paper 70. The paper after fixing is discharged onto a copy receiving tray 90 by a pair of paper discharging rollers.

A driving motor 81 for rotating the photosensitive drum 52 is installed above the vacuum conveyor 80, and a control box 92 is formed above the fixing apparatus 84, and electronic components for control system as described later are incorporated in this control box 92.

Figure 4:
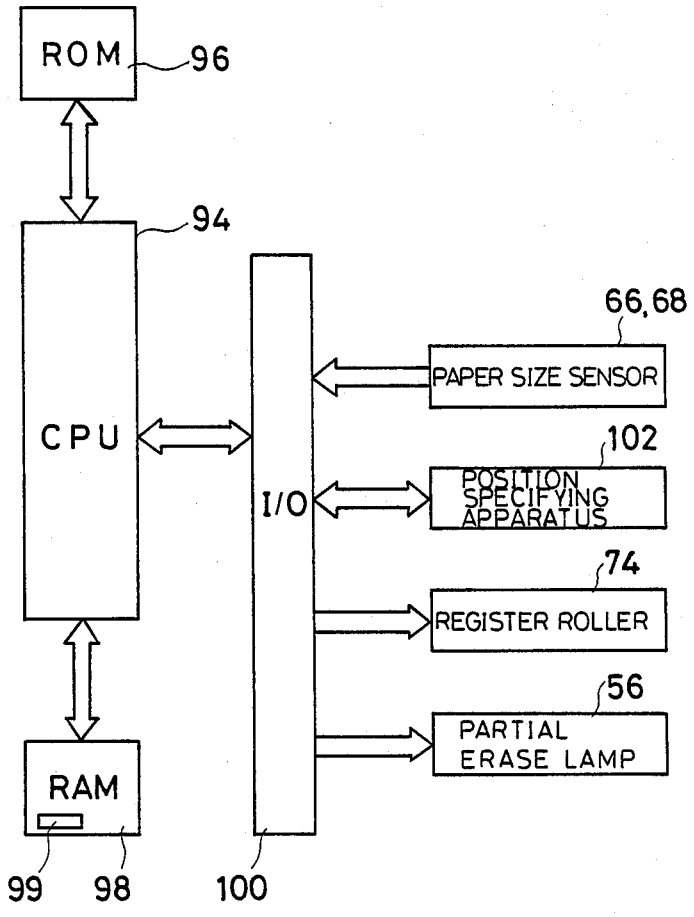
FIG. 4 is a block diagram showing one example of a controlled system of this embodiment.

FIG. 4 is a block diagram showing one example of a control system of this embodiment. A control system includes a CPU 94. The CPU 94 controls the whole operations of the electrophotographic copying machine 10. A ROM 96 for storing a control program and so on and a RAM 98 which temporarily stores data during control by the CPU 94 and has a region for various flags required for the control, a timer region and a table 99 for the partial erase lamp 56 as described later are connected to the CPU 94. Also, the above-described paper size sensors 66 and 68 are connected to the CPU 94 through and I/O port 100, an a position specifying apparatus 102 including the tablet 28 is also connected thereto. The partial erase lamp 56 is connected to the I/O port 100, and accordingly, lighting and putting out of a plurality of LEDs **56*l*–56*m* (FIG. 8 or FIG. 9) contained in the partial erase lamp 56 are controlled by the CPU 94. A mechanism (for example, a clutch solenoid) for the register roller 74 is further connected to the I/O port 100, and accordingly opening, closing and timing of opening and closing of the register roller 74 are controlled by the CPU 94**.

Figure 5:
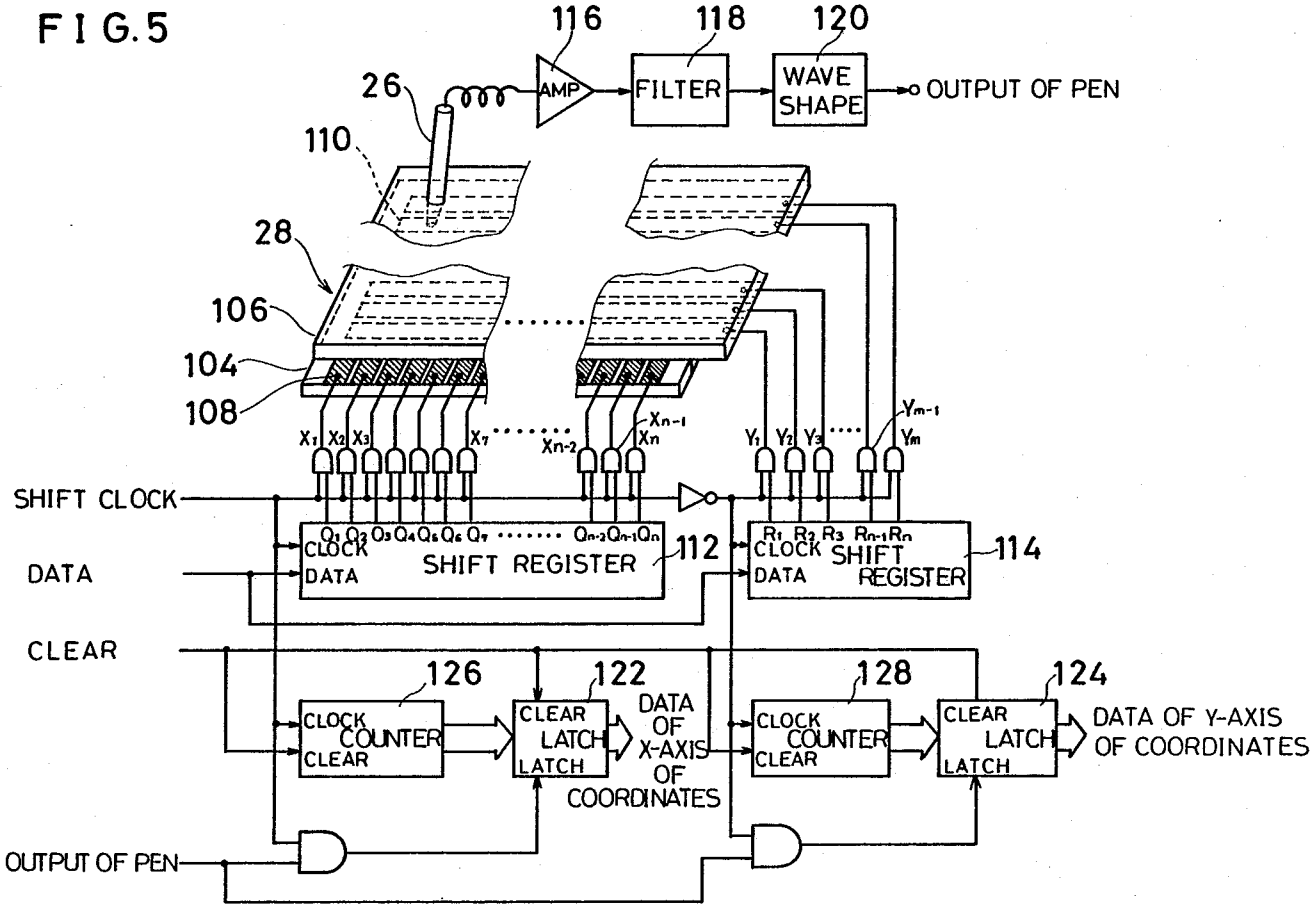
FIG. 5 is a block diagram showing a position specifying apparatus of FIG. 4 including a tablet.

In reference to FIG. 5, the tablet 28 is formed by superposing two transparent sheets 104 and 106. A pluraity of strip-shaped transparent electrodes 108, 108,—and 110, 110,—are formed on the surfaces to be superposed of the respective transparent sheets 104 and 106 so as to be orthogonal to each other. In other words, a matrix is formed by the transparent electrodes 108 and 110, and the direction of arrangement of the transparent electrodes 108 is equivalent to the X-axis and the direction of arrangement of the transparent electrodes 110 is equivalent to the Y-axis. Accordingly, by an action of the write pen 26 on the table 28, the position on the X-axis and the position on the Y-axis can be detected.

Figure 6:
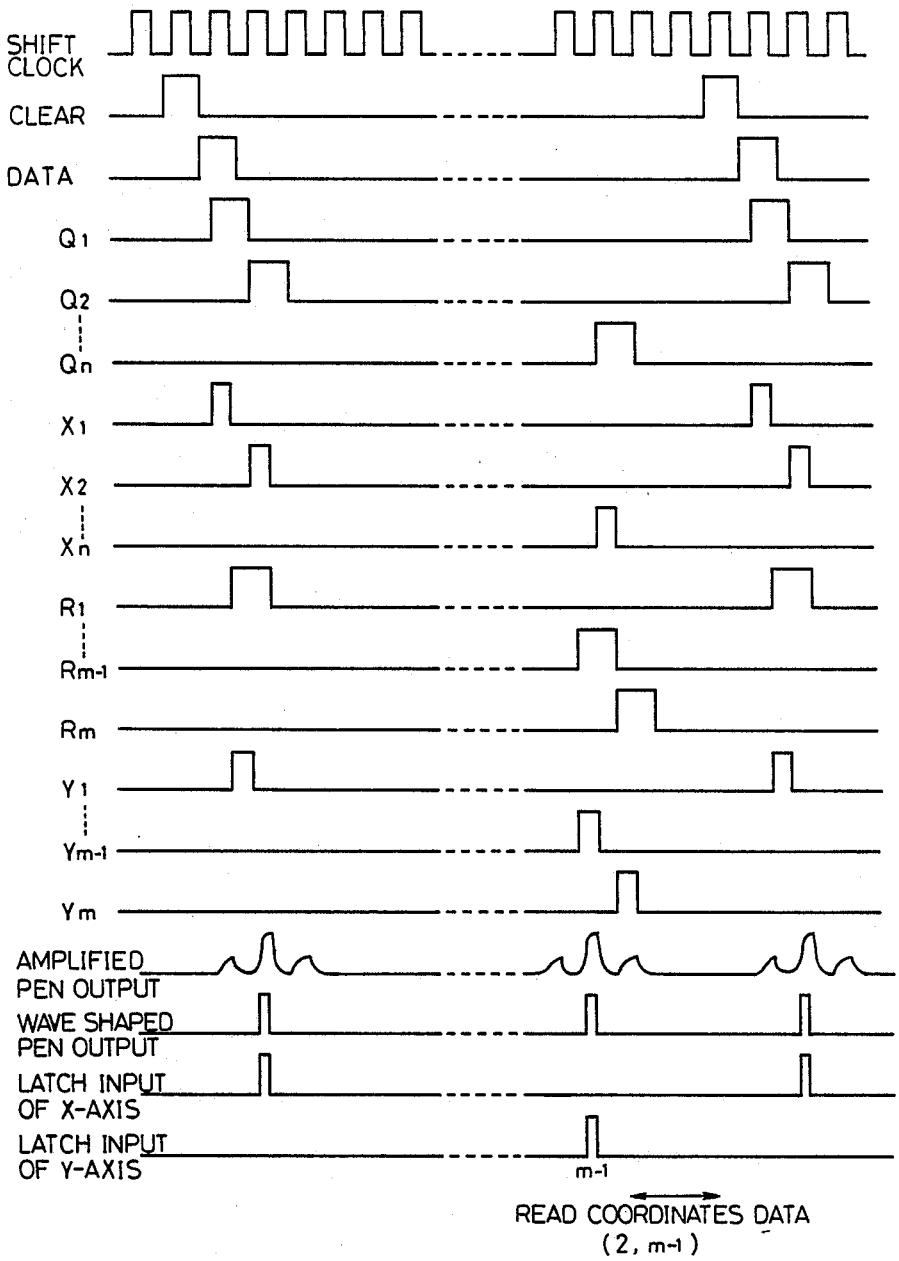
FIG. 6 is a timing chart showing operation of FIG. 5.

As shown in FIG. 6, sequential outputs Q1, Q2, Q3,—Qn-1, Qn of a shift register 112 are processed by an AND gate along with the clock signal and are applied to the respective transparent electrodes 108 as scanning voltages X1, X2, X3,—Xn-1, Xn.

As shown in FIG. 6, sequential outputs R1, R2, R3,—Rn-1, Rn of a shift register 114 are processed by an AND gate together with the clock signal and are applied to the respective transparent electrodes 110 as scanning voltages Y1, Y2, Y3,—Yn-1, Yn.

When the write pen 26 is brought in contact with or close to the tablet 28, as shown in FIG. 6, a voltage is induced on the write pen 26 by electrostatic induction from the transparent electrodes 108 and 110 just under the write pen 26. The voltage obtained on the write pen 26 is amplified by an amplifier 116, and noise is eliminated by a filter 118, and thereafter the voltage undergoes waveform-processing by a wave shaper 120, being inputted to latching circuits 122 and 124 as a pulse signal.

On the other hand, counters 126 and 128 are installed, and the same clock signal as the clock signal given to the shift registers 112 and 114 is given to these counters 126 and 128. Accordingly, the counters 126 and 128 are incremented in synchronism with the outputs Q1, Q2,—and R1, R2,—of the shift registers 112 and 114. Then, the latching circuits 122 and 124 receive outputs of these counters 126 and 128. Accordingly, as described above, when pulse output from the write pen 26 is inputted to the latching circuits 122 and 124, as shown in FIG. 6, the counted values of the counters 126 and 128 at that timing are latched by the latching circuits 122 and 124, respectively. Thus, the coordinate position can be specified by the tablet 28 and the write pen 26.

Figure 7A:
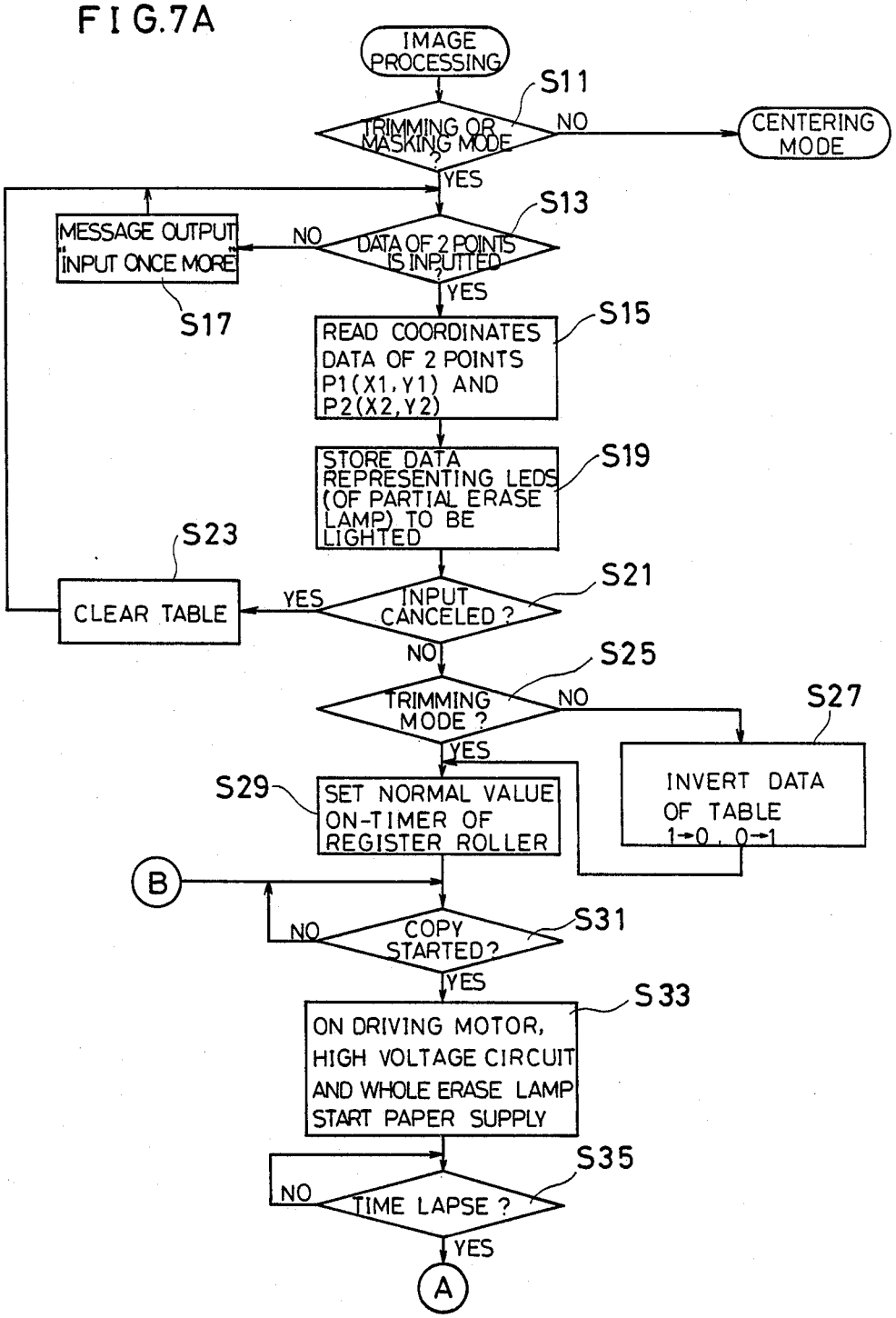
FIG. 7A, FIG. 7B and FIG. 7C are flowcharts showing operation of one embodiment in accordance with the present embodiment.
Figure 7B:
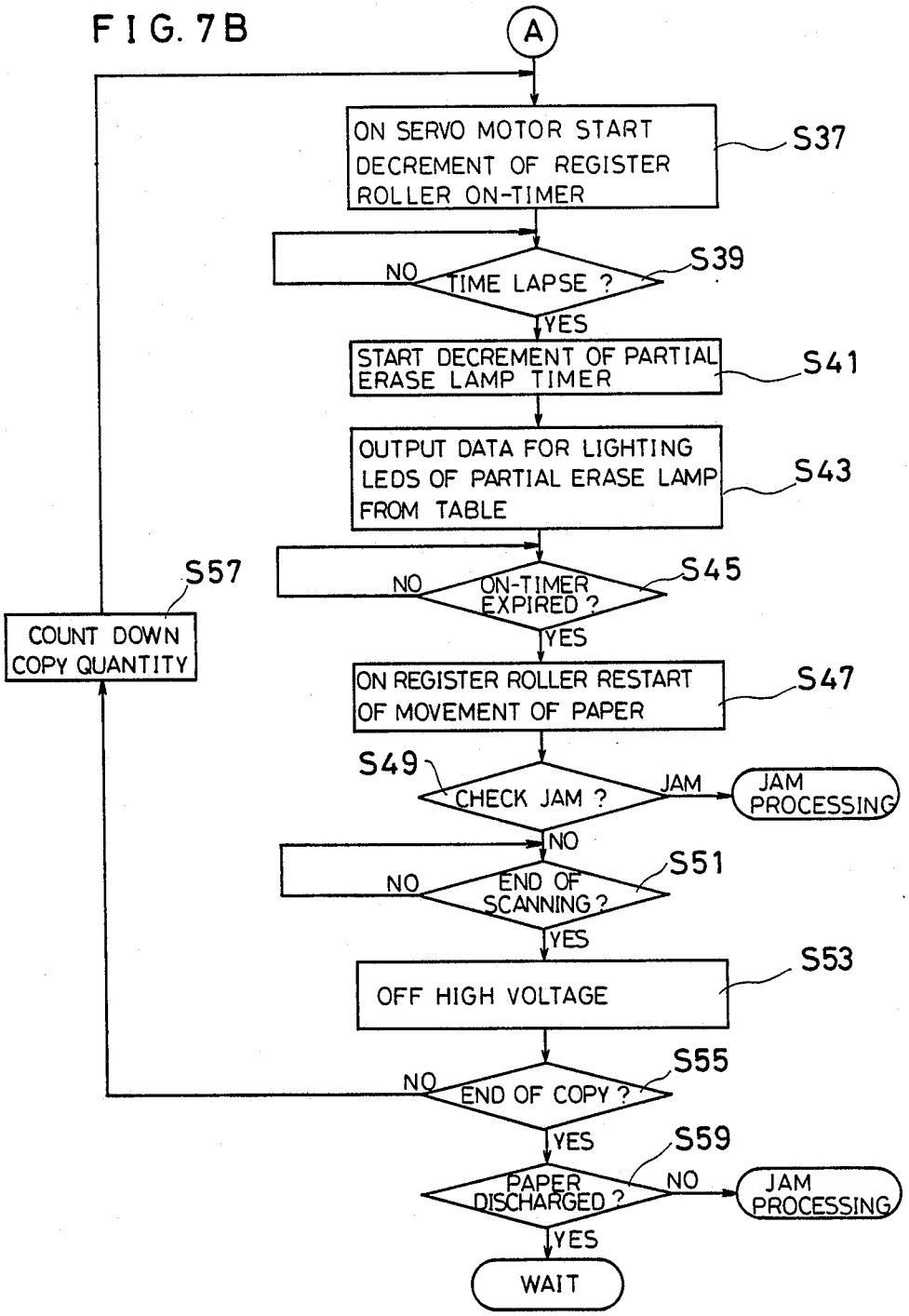
Figure 7C:
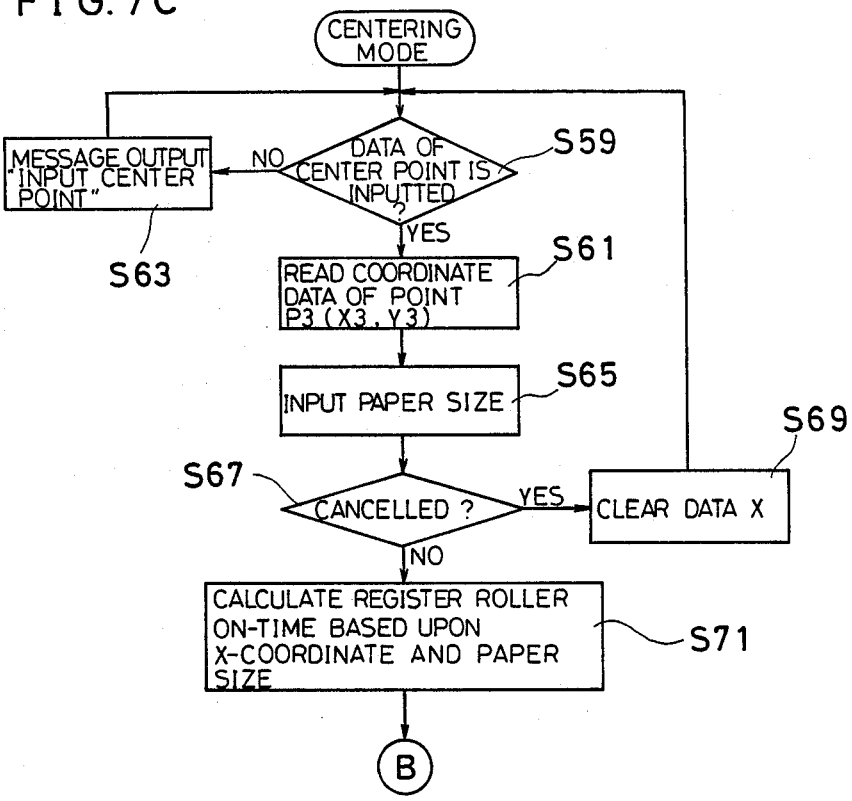

Next, description is made of operation of this embodiment based on flowcharts as shown in FIG. 7A, FIG. 7B and FIG. 7C in reference to FIG. 4. Meanwhile, controls on the normal electrophotographic copying machines are well known, and here description is made principally on the controls for editing, that is, trimming, masking and centering.

Figure 10:
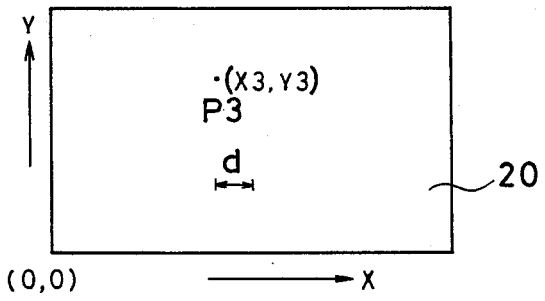
FIG. 10 is an illustrative view showing a centering mode.

Prior to description of operation, schematic description is made of the trimming mode, the masking mode and the centering mode respectively in reference to FIG. 8–FIG. 10.

In the trimming mode, as shown in FIG. 8, only the portion of the electrostatic latent image equivalent to a rectangular region 130 connecting two specified points P1(X1, Y1) and P2(X2, Y2) is left intact and the remaining portion of the electrostatic latent image, as shown by oblique lines in FIG. 8, is erased. Accordingly, in this mode, a plurality of LEDs **56*l*–56*m* contained in the partial erase lamp 56 are lighted only outside this region 130**.

In the masking mode, as shown in FIG. 9, only the portion of the electrostatic latent image equivalent to a rectangular region 132 connecting two specified points P1(X1, Y1) and P2(X2, Y2) (shown by oblique lines in FIG. 9) is erased, and the remaining portion of the electrostatic latent image is left intact. Accordingly, in this mode, a plurality of LEDs **56*l*–56*m* contained in the partial erase lamp 56 are lighted only in this region 132**.

In the centering mode, as shown in FIG. 10, only one point is specified, and based on the coordinate data of that point P3(X3, Y3), the center of the toner image in the direction of the X-axis is registered with the point P3 in transferring the toner image onto the paper. This means that, in this mode, the partial erase lamp 56 is not used, and as described later, the paper feed timing is controlled by the coordinate data and the paper size.

Before starting the copying process, the operator first opens the original cover 22 and puts the original 20 on the original holding plate 18 so that the original face thereof faces upward. Subsequently the operator closes the original cover 22. At this time, the original holding plate 18 is deformed against the elastic force of the coil springs 16 and the original face of the original 20 is flattened.

Thereafter, the operator pulls out the flexible tablet 28 while gripping the knob part 32, and disposes the same on the original cover 22. Then, as shown in FIG. 1, the operator specifies the position on the tablet 28, that is, the position on the original face of the original 20 intended to be edited using the write pen.

By a mode-select switch (not illustrated), an editing mode, that is, any one of trimming, masking and centering, is selected. In the case of the trimming or masking mode, as described above, two points P1 and P2 have to be specified. In the case of the centering mode, one point P3 has only to be specified.

In the first step S11 in FIG. 7A, the CPU 94 decides whether or not the specified editing mode is trimming or masking. Then, if the decision is made that the trimming or masking mode has been selected in this step S11, processing proceeds to step S13, and a decision is made on whether or not two points have been specified. Because, in the case of the trimming mode or the masking mode, as described above, the coordinate data of two points are required.

In step S13, if it is detected that the positions of two points on the original 20 have been inputted as shown in FIG. 8 or FIG. 9, output of the position specifying apparatus 102 (FIG. 4) including the tablet 28 is inputted to the CPU 94 through the I/O port 100. This means that the CPU 94 reads the coordinate data from the latching circuits 122 and 124 (FIG. 5) in step S15. The data of these two points P1(X1, Y1) and P2(X2, Y2) are stored temporarily in a proper region of a RAM 98.

If it is decided that the positional data of two points has not been inputted in step S13, the CPU 94 displays a message "input one more point" using displaying means (not illustrated) to call the operator's attention in step S17.

If the coordinates of the two points P1(X1,Y1) and P2(X2,Y2) are determined in step S15, the CPU 94, in step S19, calculates the lighting time and the light persisting time for each of a plurality of LEDs **56*l*–56*m* contained in the partial erase lamp 56**.

To be detailed, in the trimming mode, as shown in FIG. 8 and the following table, all the LEDs **56*l*–56*m* are to be lit, up to the position X1 of the X-axis, only the LEDs corresponding to the positions from Y1 to Y2 of Y-axis are to be out, from the position X1 to X2 of the X-axis, and all the LEDs are to be lit beyond the position X2 of the X-axis. In the masking mode, as shown in FIG. 9 and the following table, all the LEDs 56*l*–56*m*** are to be out up to the position X1 of the X-axis, and only the LEDs corresponding to the positions from Y1 to Y2 of Y-axis to be out when from the position X1 to X2 of X-axis and all the LEDs are to be out beyond the position X2 of the X-axis.

TABLE

| Partial erase time | Partial erase lamp to be lighted | |
|---|---|---|
| | Trimming | Masking |
| $0 \sim \frac{X1}{S}$ | $1 \sim m$ | Nothing (all put out) |
| $\frac{X1}{S} \sim \frac{X2}{S}$ | If $Y1 < Y2$, $\begin{cases} 1 \sim Y1 \\ Y2 \sim m \end{cases}$ | If $Y1 < Y2$, $Y1 \sim Y2$ |
| | If $Y1 > Y2$, $\begin{cases} 1 \sim Y2 \\ Y1 \sim m \end{cases}$ | If $Y1 > Y2$, $Y2 \sim Y1$ |
| $\frac{X2}{S} \sim$ End | $1 \sim m$ | Nothing (all put out) |

Then, the data of LEDs to be lit or out thus calculated are stored in the table 99 (FIG. 4) formed in the RAM 98 in step S19.

If the above-described positional data is canceled in the next step S21, the data of the table 99 are cleared in the following step S23, and processing returns to step S13.

If the input is not canceled in step S21, processing proceeds to step S25, and in this step S25, the CPU 94 decides whether or not the mode is of trimming. Such a decision is achieved by checking the state of a mode select switch (not illustrated) operated previously by the operator.

If the mode is of trimming, the CPU 94, in step S29, sets the time data in the on-timer for counting the timing when the register roller 74 (FIG. 1) is to be turned on. The time data set at this time is the same as in the case with the normal copying mode. Because, in the trimming mode (also the same in the masking mode), unlike the centering mode, no adjustment of paper feed timing is required.

If "NO" is decided in the previus step S25, that is, if the mode is not of trimming, then it is the masking mode, and the data set in the table 99 of the RAM 98 in the previous step S19 is inverted. This means that, in this masking mode, the LEDs **56*l*–56*m* contained in the partial erase lamp 56 are light or put out in an aspect quite reverse to the trimming mode. More specifically, in step S19, the data of the LEDs of the partial erase lamp 56 to be lighted and the times thereof are set in the table 99, but these data are inverted, and accordingly, as shown in the previous table, the data of the LEDs not to be lighted and the times thereof are set in the table 99**.

After the normal time data is set in the on-timer for the register roller 74 in step S29, the CPU 94 decides whether or not copying has been initiated, that is, a copy button (not illustrated) has been operated in step S31. Then, if the copy button has been operated, processing proceeds to the next step S33.

In step 33, the driving motor 81 for rotating the photosensitive drum 52, high-voltage circuits for the charging corotron 54 and the like, and the full erase lamp 83 and so on are supplied with voltage, and the paper 70 starts to be transferred from the paper feed cassette 62 or 64 toward the register roller 74 by the paper roller 72.

Next, in the step S35, a certain idling time is counted based on a program of copying processing incorporated in a ROM 96.

After the lapse of a certain time, in the next step S37, the servo motor for scanning the movable light source 38 and the movable mirror 42 are energized, and the on-timer for the register roller 74 set in the previous step S29 initiates decrement.

Then, in step S39, if the lapse of a certain time is detected as in step S35, in the following step S41, the timer of the partial erase lamp 56 formed in the RAM 98 initiates a decrement based on the time data set in the table 99 of the RAM 98.

Next, in step S43, based on the LED data set in the table 99 in the previous step S19, the CPU 94 lights the LEDs to be lighted in the partial erase lamp 56.

In the following step S45, decision is made on whether or not there has been an expiration of the on-timer for register roller 74 initiating decrement in the previous step S37. If the timer has expired, the CPU 94, in step S47, gives a signal to a mechanism, for example, a clutch solenoid for the register roller 74. Responsively, the register roller 74 is turned on, and the paper 70 is transferred again toward the photosensitive drum 52.

In the next step S49, jamming is checked. if the paper 70 jams, the jam is displayed on the displaying means, and the jam processing is performed.

If no jamming is detected, in the next step S51, the CPU 94 decides whether or not exposure-scanning of the original face of the original 20 by means of the movable light source 38, the movable mirror 42 and the like has been completed.

If the exposure-scanning has been completed, in step S53, the CPU 94 turns off the power sources for the charging corotron 54, the movable light source 38 and so on. Then, in step S55, decision is made on whether or not copying has been completed. If copying has been completed, processing proceeds to step S59, and if not completed, the copy quantity is counted down in step S57, and processing returns to step S37.

In step S59, decision is made on whether or not the paper 70 has been discharged onto the copy receiving tray 90. If the paper 70 has been discharged, the copying machine is put in the standby state, and if not discharged, jam processing is performed as in the previous step S49.

Next, when the trimming mode or the masking mode is not selected in step S11, that is, when the centering mode is selected, processing proceeds to the routine shown in FIG. 7C, and in step S59, decision is made on whether or not point input by means of the write pen 26 and the tablet 28 has been performed. If point input has been performed, processing proceeds to step S61, and if not performed, the CPU 94, in the step S63, has the displaying means display a message "input center point" to call the operator's attention.

In the next step S61, the CPU 94 takes only the position X3 on the X-axis of the pointP3(X3, Y3) inputted from the latching circuit 122 included in the position specifying apparatus 102 into the RAM 98.

Also, in step 65, the output of the paper size sensor 66 or 68 is inputted to the CPU 94 through the I/O 100.

Next, in step 67, decision is made on whether or not position-specifying has been canceled. If input has been canceled, the CPU 94, in step S69, clears the data stored in the RAM 98 in the previous step S61, and processing returns to step S59.

If no input is canceled, in step S71, the CPU 84 calculates the timing for turning on the register roller 74, based on the positional data of X3 stored in the RAM 98 and the size data detected by the paper size sensor 66 or 68.

Figure 11:
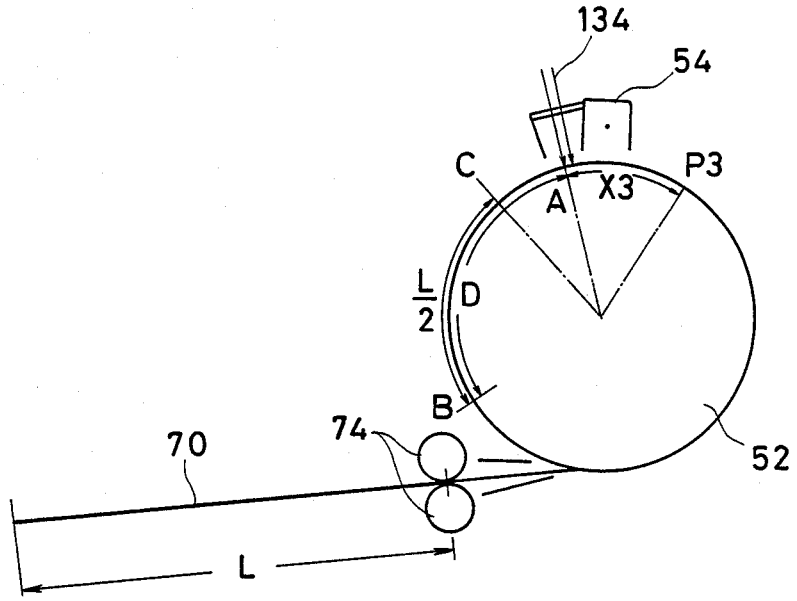
FIG. 11 is an illustrative view showing on-timing of a register roller in the centering mode.

To be detailed, in the case of the normal copying, as shown in FIG. 11, the reflected light 134 is projected from a point A, and an electrostatic latent image is formed on the rotating photosensitive drum 52. When the photosensitive drum 52 is rotated and this point A reaches a point B, the register roller 74 is turned on, and the paper 70 is transferred toward the photosensitive drum 52 at that timing. Accordingly, in the case of the normal copying, the tip of the paper 70 coincides with the point A of the tip of the electrostatic latent image, and the tip of the copied image coincides with the tip of the paper.

On the other hand, in the centering mode, the timing of operation of the register roller 74 is controlled so that the center of the copied image in the direction of X-axis coincides with the specified position. In other words, in the centering mode, the copied image is moved parallel to the direction of the X-axis by advancing or delaying the timing when the register 74 is to be turned on. This means that, as shown in FIG. 10, when the X-axis position X3 of the point P3 is moved parallel to the direction of the X-axis by a distance d, in FIG. 11, the register roller 74 has only to be turned on when a pivot equivalent to the position of X3 coincides with a point C. Then, the copied image is moved in a parallel fashion by the distance d, being disposed at the center of the paper. A time t enabling point P3 to coincide with the point C is given by the following equation, $$t = \frac{D - L/2 + X3}{S},$$

providing that $D \geqq L/2$ where,

D: distance from point A to point B on the peripheral surface of photosensitive drum 52

L: length of paper 70

S: peripheral velocity of photosensitive drum 52

Thus, in step S71, the time t of advance or delay of the timing when the register roller 74 is turned on is calculated. This time t corresponds to the time when decrement is initiated for the on-timer for the register roller 74 set in the previous step S29.

If the time t for adjusting the timing when the register roller 74 is turned on is calculated in step S71, processing returns to step S31 as shown in FIG. 7A. Operations in step S31 and following steps are the same as in the above-described trimming or masking mode except that, in step S37, decrement of the on-timer for the register roller 74 set in the step S29 is initiated based on the time t calculated in step S71.

Figure 12:
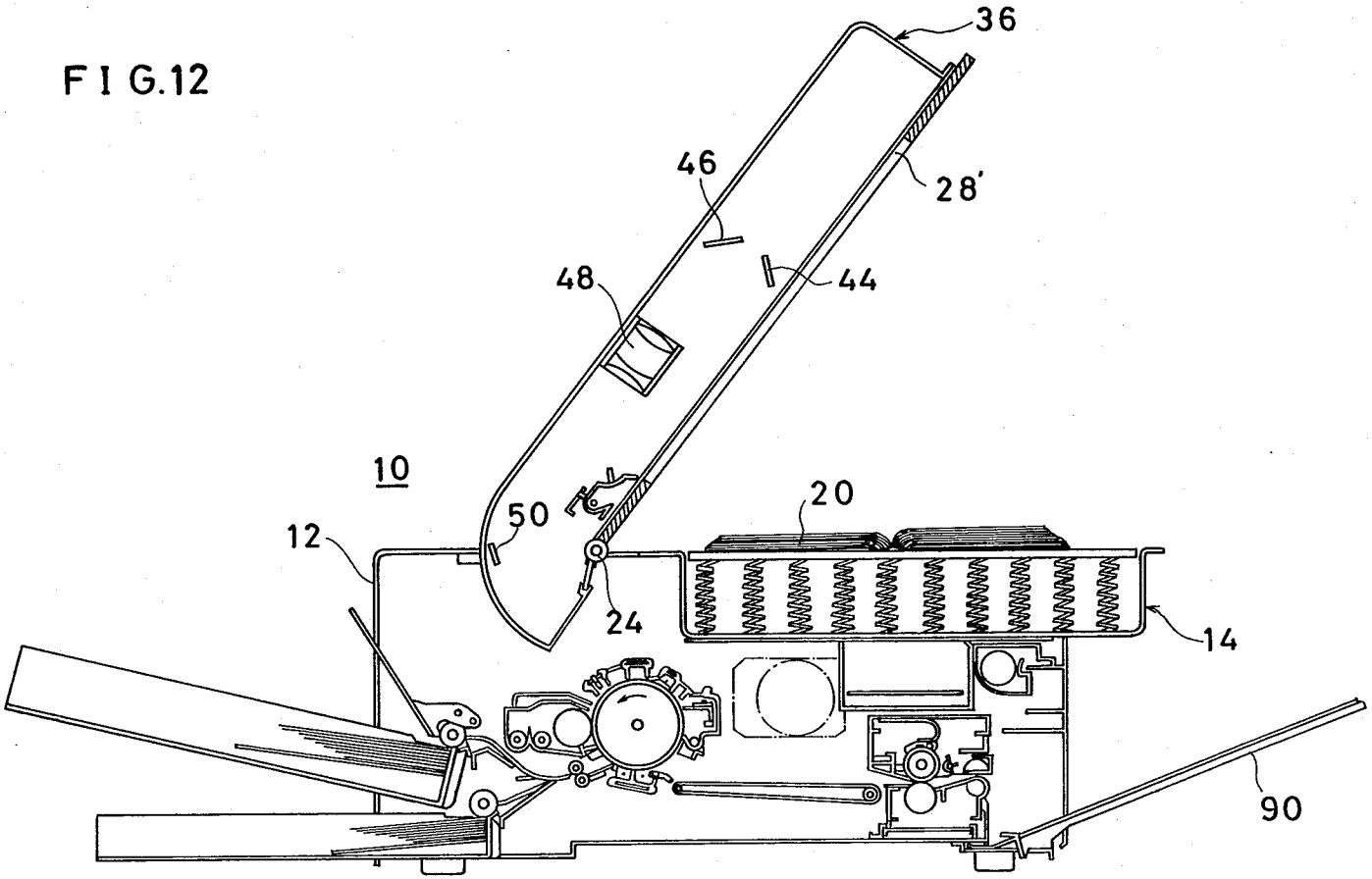
FIG. 12 is an illustrative structural view showing another embodiment in accordance with the present invention.

FIG. 12 is an illustrative cross-sectional view showing an inner structure of an electrophotographic copying machine of another embodiment in accordance with the present invention. This embodiment is the same as FIG. 1 embodiment except for the following. More specifically, in the embodiment as shown in FIG. 1, the tablet 28 installed on the original cover 22 can be accommodated while spooled up by the roller 30, but in this embodiment, like the optical system 36, a tablet 28' which can be opened or closed is used. To be detailed, the tablet 28' formed by a rigid body, for example, glass or acrylate resin is installed so as to be capable of opening upward or closing downward by the same shaft 34 supporting the optical system 36. This tablet 28' can be used also as an original cover, and accordingly in this embodiment, the original cover 22 (FIG. 1) can be dispensed with.

Figure 13:
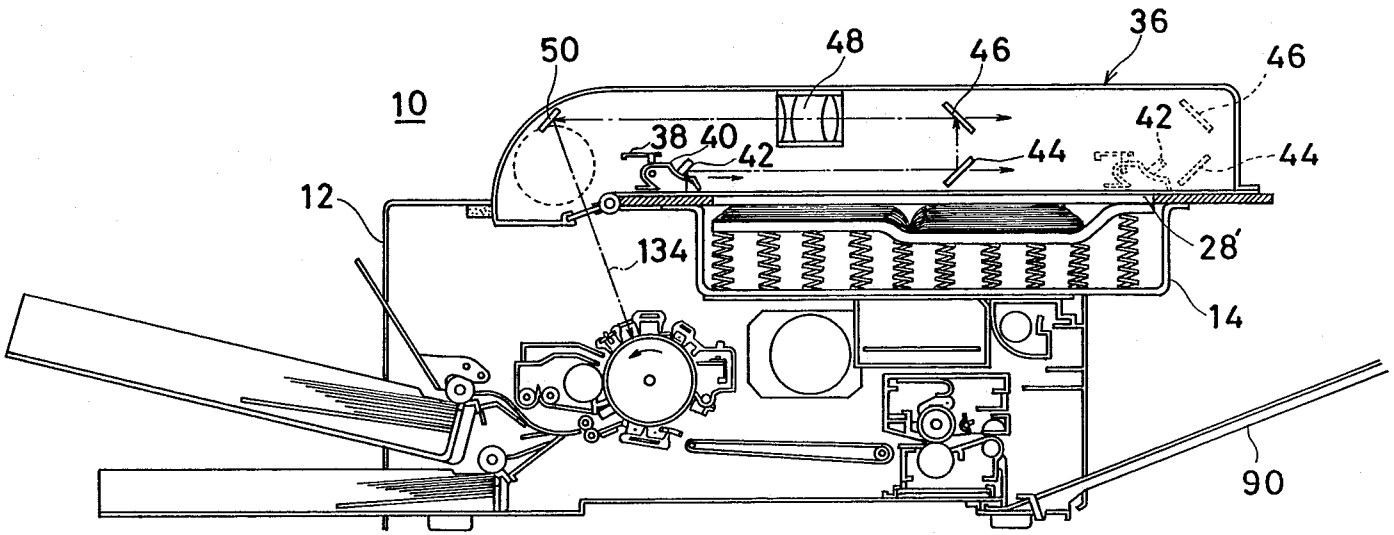
FIG. 13 is an illustrative structural view showing operation of the FIG. 12 embodiment.

In this embodiment, the tablet 28' cannot be removed, and therefore after specifying the position using the tablet 28' and the write pen 26 as shown in FIG. 13, copying processing is executed with the tablet 28' left intact between the original face of the original 20 and the optical system 36. However, depending upon material to be used, the light transmission factor of the tablet 28' is not poor, for example, 75% or more, and therefore no deleterious effects result.

Figure 14:
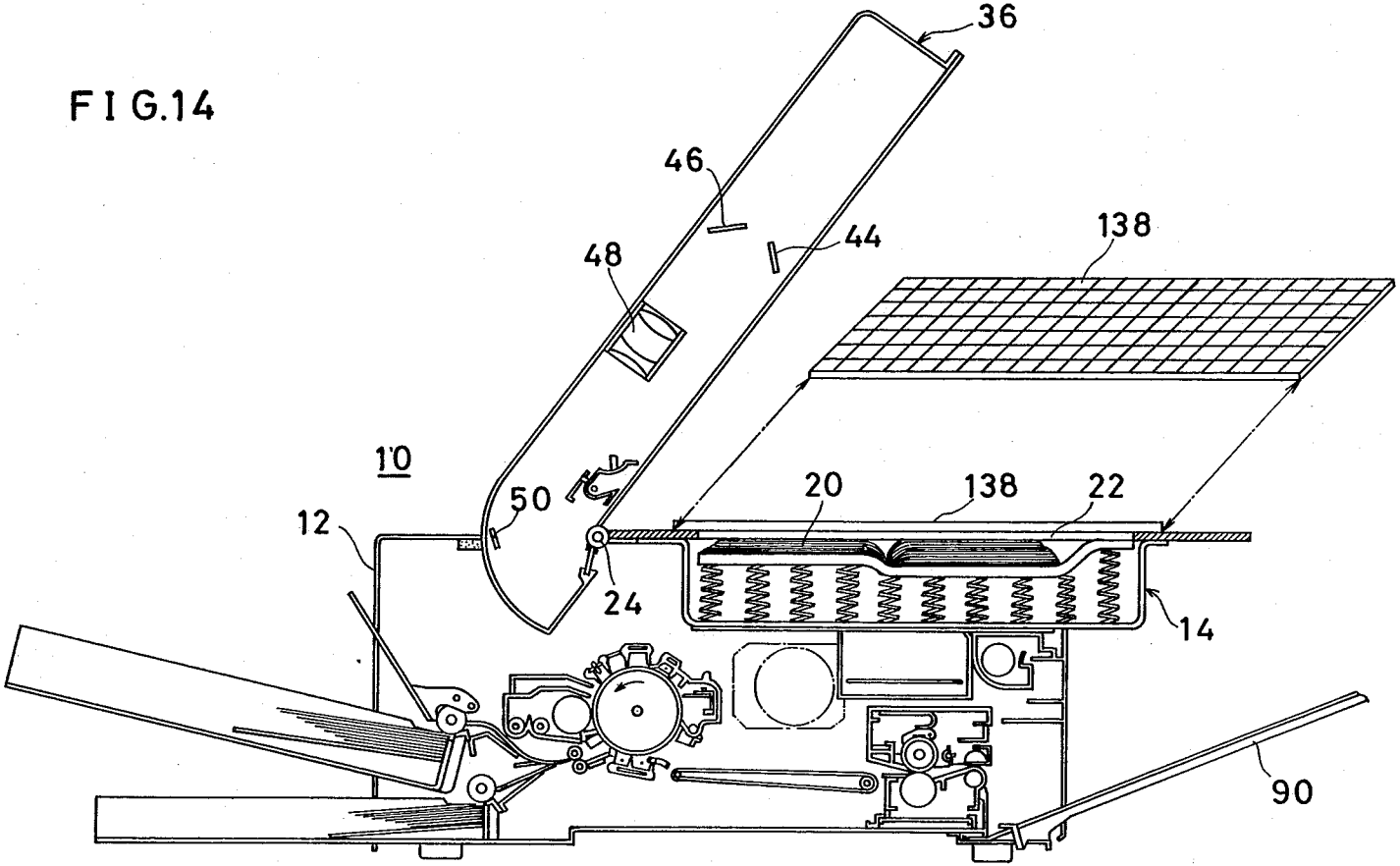
FIG. 14 is aan illustrative structural view showing still another embodiment in accordance with the present invention.

Furthermore, in place of the method of specifying the position using the tablet and the write pen as described above, as shown in FIG. 14, a method may be applied wherein a transparent or semi-transparent sheet 138 with lattice graduations is used, and the same is placed on the original cover 22 only when specifying the position, sheet 138 being removed after completing the position specifying. In this case, the position specifying for editing is performed using another keyboard while watching the graduations on the sheet 138.

A tablet constituted as a separate piece like this sheet 138 may be used. In that case, when the position is specified, a tablet of separate piece is placed on the original cover 22, and thereafter the tablet is removed to execute the copy processing.

Figure 15:
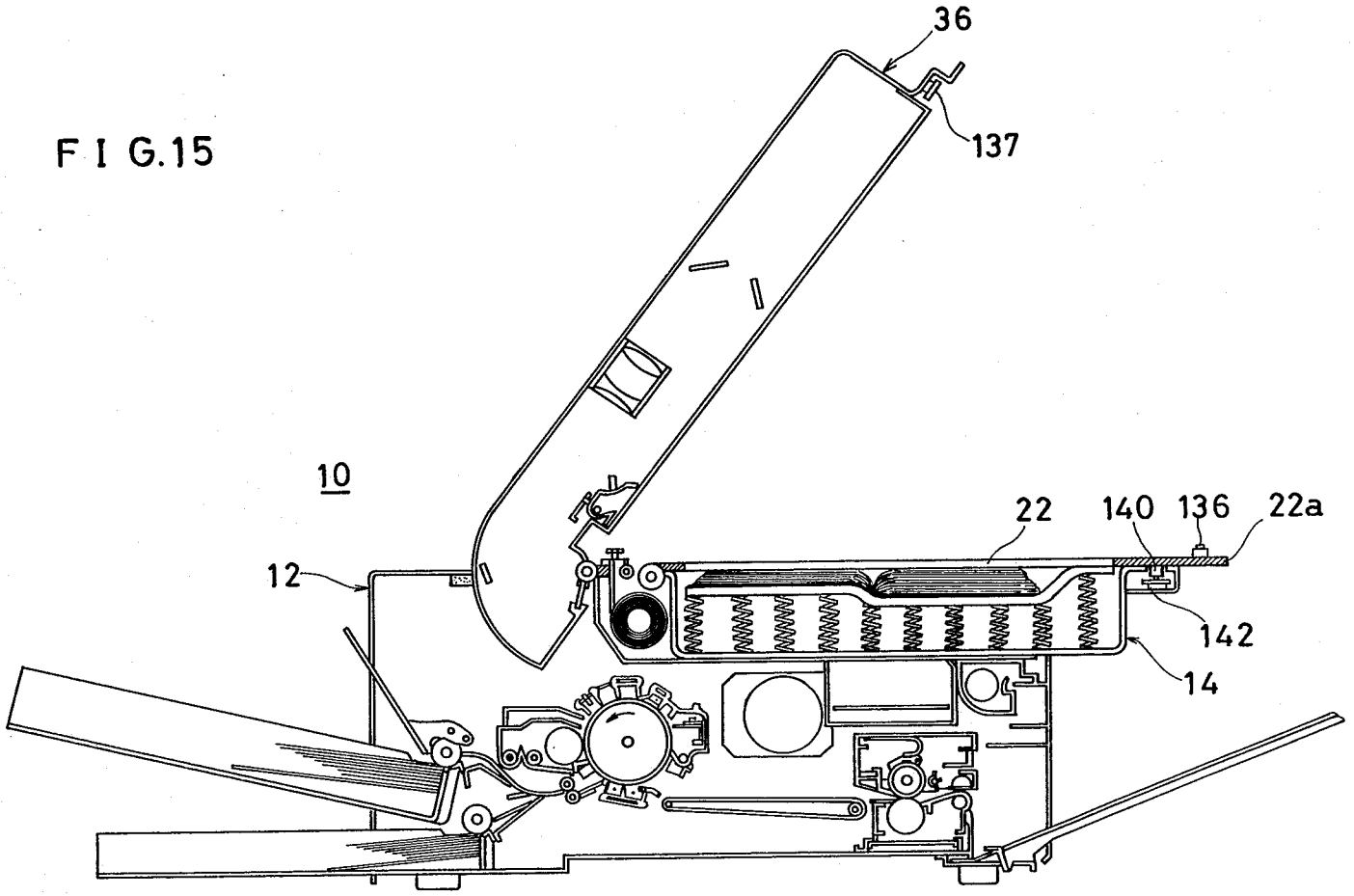
FIG. 15 is an illustrative structural view showing another embodiment in accordance with the present invention.

FIG. 15 is an illustrative structural view showing still another embodiment in accordance with the present invention. In this embodiment, means for detecting whether or not the optical system 36 and the original cover 22 have been closed is added to the FIG. 1 embodiment. To be detailed, a first reflection-type photosensor 137 is installed on the top surface in the vicinity of the free end of the original cover 22. A reflecting plate 137 for reflecting rays of light irradiated from this first photosensor 136 is installed at the portion of the optical system 36 corresponding to this first photosensor 136. Then, when the optical system 36 is closed as shown in FIG. 3, rays of light from the first photosensor 136 are reflected by the reflecting plate 137 and are inputted again to it, and thereby a signal indicating that the optical system 36 has been closed is outputted from the first photosensor 136.

Furthermore, a second reflection-type photosensor 140 is installed somewhat nearer to the base end than to the free end of the original cover 22. Then, a reflecting plate 142 for reflecting rays of light irradiated from the second photosensor 140 is mounted on the portion of the original table 14 corresponding to the second photosensor 140. When the original 20 placed on the original table 14 is covered by the original cover 22, rays of light from the second photosensor 140 are reflected by the reflecting plate 142 and are inputted again to it, and thereby a signal indicating that the original 20 has been covered by the original cover 22 is outputted from the second photosensor 140.

In this embodiment, copying is allowed to initiate only in response to outputs from the above-described two photosensors 136 and 140.

Meanwhile, in the above-described embodiment, in the trimming or masking mode, the region 130 or 132 to be trimmed or masked is defined as a rectangular region by specifying the two points P1(X1, Y1) and P2(X2,Y2). However, for the shape of this region, a complicated shape such as a flat ellipse may be used in addition thereto. At this time, the position to be inputted by the write pen 26 has only to be a line rather than a point.

Also, in the above-described embodiment, in the centering mode, the original is moved parallel to he X-axis, but it can also be moved parallel to to the Y-axis. At this time, the position of the electrostatic latent image formed on the photosensitive drum 52 may be moved parallel to the Y-axis on the copied image face, or the position of the paper 70 sent by the register roller 74 may be shifted in the direction of the Y-axis.

In addition, in the embodiment, the optical system 36 is supported at the left end part of the operating part (not illustrated) on the main unit 12. However, the supporting part of the optical system 36 may be installed at the right end of the main unit 12 or further at the rear end of the main unit 12.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electrophotographic copying machine having editorial function comprising:

an original table for placing an original with an original face to be copied facing upward, said original table including supporting means for supporting said original from under its original face, said supporting means being upwardly and downwardly displaceable relative to said original, a tablet which is composed of a transparent or semi-transparent material, and is disposed on said original face of said original placed on said original table, said tablet including a pen movable to specify position on said tablet, said tablet including means for generating positional data representing the position of said pen, optical scanning means which has a movable light source and is for scanning said original face, a photosensitive member which is exposed by light from said optical scanning means and forms an electrostatic latent image thereon, and image forming means for forming a copied image in accordance with positional data from said tablet by means of an electrostatic latent image formed on said photosensitive member and said positional data.

2. An electrophotographic copying machine having editorial function in accordance with claim 1, wherein said image forming means includes modifying means for modifying an electrostatic latent image formed on said photosensitive member based on said position data from said tablet.

3. An electrophotographic copying machine having editorial function in accordance with claim 2, wherein said modifying means includes a partial erase lamp for partially removing charges on said photosensitive member.

4. An electrophotographic copying machine having editorial function in accordance with claim 3, wherein said partial erase lamp includes a plurality of light emitting devices arranged in the direction of width of said photosensitive member, further comprising means for selectively lighting or putting out a plurality of said light emitting devices in accordance with said positional data.

5. An electrophotographic copying machine having editorial function in accordance with claim 2, wherein said image forming means includes developing means for toner-developing an electrostatic latent image formed on said photosensitive member and transferring means for transferring a toner image toner-developed onto a paper in accordance with said positional data.

6. An electrophotographic copying machine having editorial function in accordance with claim 5, which further comprises means for determining timing of transfer by said transferring means.

7. An electrophotographic copying machine having editorial function in accordance with claim 6, wherein said means for determining said timing of transfer includes stopping means for stopping said paper once and sending the same again toward said photosensitive member.

8. An electrophotographic copying machine having editorial function in accordance with claim 1, wherein said supporting means includes an elastic body disposed under said original.

9. An electrophotographic copying machine having editorial function in accordance with claim 1, wherein said supporting means includes a flexible original holding plate supported by a plurality of coil springs.

10. An electrophotographic copying machine having editorial function in accordance with claim 1, which further comprises holding means for holding said tablet in a manner capable of attaching on or detaching from said original face.

11. An electrophotographic copying machine having editorial function in accordance with claim 10, wherein said tablet is constituted as a separate piece.

12. An electrophotographic copying machine having editorial function comprising:

an original table for placing an original with an original face to be copied facing upward, a tablet which is composed of a transparent or semi-transparent material, and is disposed on said original face of said original placed on said original table, said tablet including a pen movable to specify position on said tablet, said tablet including means for generating positional data representing the position of said pen, optical scanning means which has a movable light source and is for scanning said original face, a photosensitive member which is exposed by light from said optical scanning means and forms an electrostatic latent image thereon, image forming means for forming a copied image in accordance with positional data from said tablet by means of an electrostatic latent image formed on said photosensitive member and said positional data, holding means for holding said tablet in a manner capable of attaching or detaching said tablet from said original face, said tablet being composed of a flexible material, and said holding means including means for spooling up said tablet.

13. An electrophotographic copying machine having editorial function in accordance with claim 12, wherein said holding means includes means for holding rotatably said tablet, and said tablet can be opened or closed to said original face.

14. An electrophotographic copying machine having editorial function comprising:

an original table for placing an original with an original face to be copied facing upward, a tablet which is composed of a transparent or semi-transparent material, and is disposed on said original face of said original placed on said original table, said tablet including a pen movable to specify position on said tablet, said tablet including means for generating positional data representing the position of said pen, optical scanning means which has a movable light source and is for scanning said original face, photosensitive member which is exposed by light from said optical scanning means and forms an electrostatic latent image thereon, image forming means for forming a copied image in accordance with positional data from said table by means of an electrostatic latent image formed on said photosensitive member and said positional data, and mounting means for mounting said optical scanning means in a manner capable of opening and closing with respect to said original face.

15. An electrophotographic copying machine having editorial function in accordance with claim 14, wherein said image forming means includes modifying means for modifying an electrostatic latent image formed on said photosensitive member based on said position data from said tablet.

16. An electrophotographic copying machine having editorial function in accordance with claim 15, wherein said modifying means includes a partial erase lamp for partially removing charges on said photosensitive member.

17. An electrophotographic copying machine having editorial function in accordance with claim 16, wherein said partial erase lamp includes a plurality of light emitting devices arranged in the direction of width of said photosensitive member, further comprising:

means for selectively lighting or putting out a plurality of said light emitting devices in accordance with said positional data.

18. An electrophotographic copying machine having editorial function in accordance with claim 14, wherein said image forming means includes developing means for toner-developing an electrostatic latent image formed on said photosensitive member and transferring means for transferring a toner image toner-developed onto a paper in accordance with said positional data.

19. An electrophotographic copying machine having editorial function in accordance with claim 18, which further comprises means for determining timing of transfer by said transferring means.

20. An electrophotographic copying machine having editorial function in accordance with claim 19, wherein said means for determining said timing of transfer includes stopping means for stopping said paper once and sending the same again toward said photosensitive member.

21. An electrophotographic copying machine having editorial function in accordance with claim 14, which further includes a main unit, wherein said mounting means includes a supporting part for supporting said optical scanning means in a manner capable of swinging with respect to said main unit at the upper part of said original table with the vicinity of one end part of said main unit acting as a fulcrum.

22. An electrophotographic copying machine having editorial function in accordance with claim 21, wherein said supporting part supports said optical scanning means at the vicinity of the right end part or at the vicinity of the left end part of said operating part.

23. An electrophotographic copying machine having editorial function in accordance with claim 21, wherein said supporting part supports said optical scanning means at the vicinity of the rear face end part of said main unit.

24. An electrophotographic copying machine having editorial function in accordance with claim 21, wherein said optical scanning means includes a movable light source which moves while lighting on said original, a reflecting mirror for reflecting an original image reflected from said original, and a lens for producing said original image on said photosensitive member.

25. An electrophotographic copying machine having editorial function in accordance with claim 14, which further comprises a main unit and detecting means which is installed on said main unit and is for detecting whether or not said optical scanning means has been closed.

26. An electrophotographic copying machine having editorial function in accordance with claim 25, which further comprises an original covering plate which is installed between said original table and said optical scanning means and consists of a transparent material.

27. An electrophotographic copying machine having editorial function in accordance with claim 26, wherein said detecting means includes means for detecting whether or not said original covering plate has been closed.

28. An electrophotographic copying machine having editorial function comprising:

an original table for placing an original with an original face to be copied facing upward, a graduation member which has coordinate graduations and is disposed removably from said original face of said original placed on said original table, said graduation member being formed of a transparent or semitransparent material so as to be able to see said original face through said graduation member, position specifying means for specifying a position of said original face to be edited by sight through said graduation member, specified positional data being outputted from said position specifying means, optical scanning means for scanning said original face whereon said graduation member is removed on said original face, a photosensitive member which is exposed by light from said optical scanning means and forms an electrostatic latent image thereon, and image forming means for forming a copied image responding to said specified positional data by means of said electrostatic latent image formed on said photosensitive member and said specified positional data.

* * * * *